US006406263B1

(12) United States Patent
Meacham et al.

(10) Patent No.: US 6,406,263 B1
(45) Date of Patent: Jun. 18, 2002

(54) GAS TURBINE SHAFT PILOT SYSTEM WITH SEPARATE PILOT RINGS

(75) Inventors: Walter L. Meacham, Phoenix; Eric W. Lloyd, Mesa, both of AZ (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/642,679

(22) Filed: Aug. 21, 2000

Related U.S. Application Data

(63) Continuation-in-part of application No. 09/290,593, filed on Apr. 13, 1999.

(51) Int. Cl.[7] ..... F03B 11/04

(52) U.S. Cl. ..... 416/194; 416/195; 416/196 R; 416/198 A; 416/244 R

(58) Field of Search ..... 416/198 A, 194, 416/195, 196 R, 244 A, 244 R, 170 R

(56) References Cited

U.S. PATENT DOCUMENTS

| | | | | |
|---|---|---|---|---|
| 2,356,605 A | | 8/1944 | Meininghaus | |
| 2,772,853 A | | 12/1956 | Woodworth | |
| 3,617,150 A | | 11/1971 | Wagle | |
| 3,689,177 A | | 9/1972 | Klassen | |
| 3,888,602 A | * | 6/1975 | Nichols et al. | 416/198 A |
| 3,894,324 A | | 7/1975 | Holzapfel et al. | |
| 4,247,256 A | | 1/1981 | Maghon | |
| 4,737,076 A | | 4/1988 | Bonner et al. | |
| 4,767,276 A | * | 8/1988 | Barnes et al. | 416/220 R |
| 5,232,337 A | | 8/1993 | Glynn | |
| 5,628,621 A | * | 5/1997 | Toborg | 416/198 A |
| 5,664,413 A | | 9/1997 | Kington et al. | |

* cited by examiner

*Primary Examiner*—F. Daniel Lopez
*Assistant Examiner*—James M McAleenan
(74) *Attorney, Agent, or Firm*—Robert Desmond, Esq.

(57) ABSTRACT

A turbine assembly comprising a first rotatable component having a first lip with a first axial facing surface and a second rotatable component having a second lip with a second axial facing surface. The components are held together by an axial load so that the first and second axial surfaces are in frictional contact across a radial plane whereby torque is transmitted between the components. A pilot ring mounted either above or below the radial contact plane maintains the radial position of the two components.

18 Claims, 6 Drawing Sheets

GAS TURBINE SHAFT PILOT SYSTEM WITH SEPARATE PILOT RINGS

REFERENCE TO A RELATED APPLICATION

This application is a continuation-in-part of copending U.S. patent application Ser. No. 09/290,593, filed Apr. 13, 1999 and entitled "Integral Ceramic Blisk Assembly".

TECHNICAL FIELD

The present invention relates to gas turbine engines and in particular to an assembly of rotating components that use single piece pilot rings for radial piloting of adjacent components and frictional contact for torque transmission between these components.

BACKGROUND OF THE INVENTION

Rings have been used in gas turbine engines for many purposes. For example, Meininghaus, U.S. Pat. No. 2,356,605 uses rings 17 between adjacent turbine rims to increase bending stiffness.

FIG. 1, in Kington et al., U.S. Pat. No. 5,664,413 shows a single piece pilot ring 54 disposed between a back-to-back centrifugal compressor and radial turbine. The pilot ring 54 serves two functions referred to as a radial function and an axial function. The radial function is maintaining concentricity between the compressor rotor 35 and the turbine rotor 37. This requires the pilot ring 54 to maintain radial contact with both rotors during assembly of the engine and during operation. During operation of the engine, the radial growth due to thermal and/or centrifugal expansion of the turbine rotor is significantly greater than that of the compressor rotor. As a result, the pilot ring 54 must roll to accomplish the radial function. The axial function is transferring the axial load between the two rotors which requires that the axial ends of the ring remain parallel. As a consequence, the ring cannot roll freely as the turbine rotor thermally grows at a faster rate than the compressor rotor, requiring large radial interference fits between the pilot ring and the rotors. Some of the disadvantages associated with large interference fits are that they require a large temperature difference of the components during assembly, the ring can pop off the compressor rotor if assembly is not completed quickly, clocking of the turbine relative to the compressor to achieve balance and "run out" is difficult, and large stresses can be generated in the ring causing it to yield which in turn can result in high vibrations in the engine.

To overcome these disadvantages, Kington further discloses a dual pilot ring 80 for use between a back-to-back centrifugal compressor and radial turbine. The dual pilot ring uncouples the axial function from the radial function by providing an inner ring for radial piloting the compressor rotor and turbine rotor, and an outer ring for transmitting axial loads. The two rings are separated by a clearance gap. As a result, the inner ring is no longer constrained by axial loads and is free to roll as the two rotors thermally and/or centrifugally grow at different rates.

Referring to FIGS. 1A and 1B, a typical prior art friction drive piloting system includes a first component 1 having a lower lip 2 clamped up to a second component 3 having an upper lip 4. The components are radially piloted through the lips 2 and 4 and axially piloted through either the upper or lower axial facing surfaces 5, 6, 7, and 8. The torque transfer is primarily carried through these axial facing surfaces when the two components are clamped together represented by the arrows labeled with an "F". Under operating conditions, the two components may grow radially at different rates due to thermal and centrifugal effects of the rotating components. These friction drive systems typically require large interference fits, represented by arrows 9, to maintain radial piloting under the varying conditions. These large interference fits make it difficult to assemble and disassemble the components. This piloting scheme has also been known to cause face distortion, see FIG. 1B, which can change the rotor unbalance and increase the engine vibrations.

Accordingly, there is a need for a turbine assembly of rotating components in a gas turbine engine that uses a single piece pilot ring for radial piloting and frictional contact for torque transmission.

SUMMARY OF THE INVENTION

An object of the present invention is to provide an assembly of rotating components that uses single piece pilot rings for radial piloting of the components and frictional contact between the faces of the assembled components for torque transmission between the components.

The present invention meets this objective by providing an assembly that includes a first rotatable component having a first lip with a first axial facing surface and a second rotatable component having a second lip with a second axial facing surface. The components are held together by an axial load so that the first and second axial surfaces are in frictional contact across a radial plane whereby torque is transmitted between the components. A pilot ring is mounted either above or below the radial contact plane to maintain the radial position of the two components. These and other objects, features and advantages of the present invention, are specifically set forth in, or will become apparent from, the following detailed description of a preferred embodiment of the invention then read in conjunction with the accompanying drawings.

DESCRIPTION OF THE PREFERRED EMBODIMENT

Figure 1B:
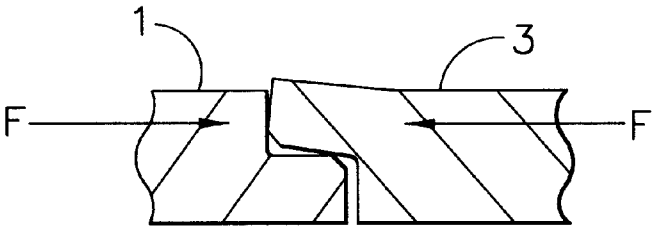
FIG. 1B (PRIOR ART)
FIGS. 1A and 1B are illustrations of a prior art friction drive piloting system.
Figure 1A:
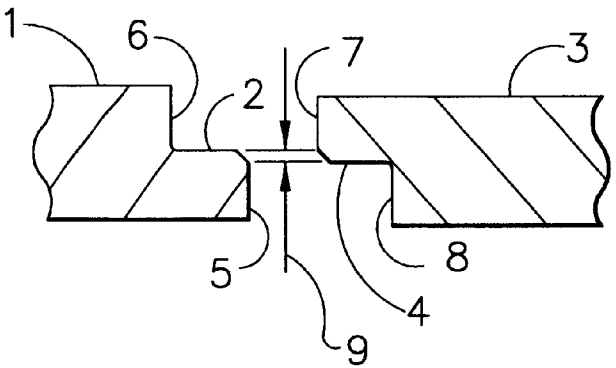
FIG. 1A (PRIOR ART)
Figure 2:
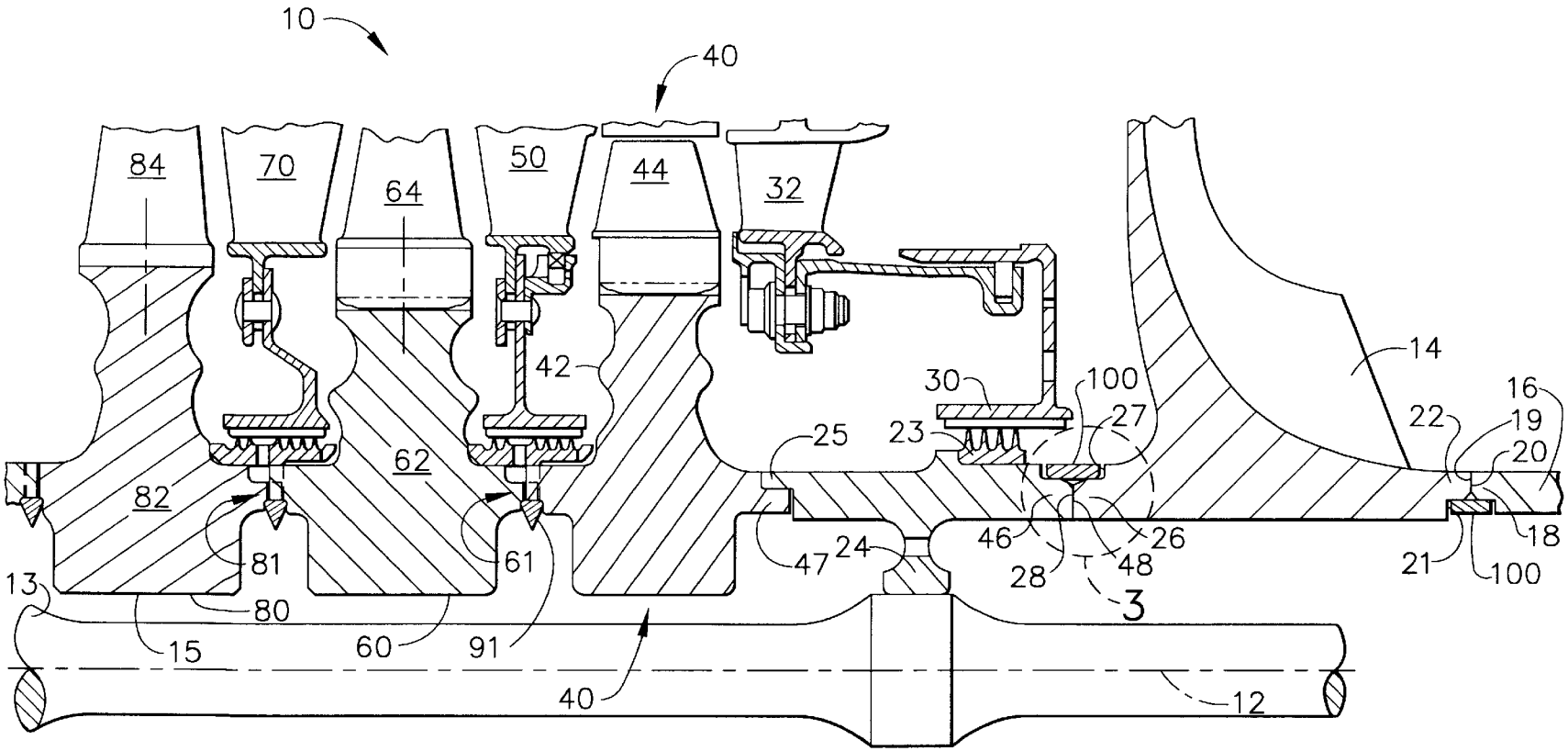
FIG. 2 is a cross-section of a gas turbine engine turbine section showing rotating components coupled as contemplated by the present invention.
Figure 3:
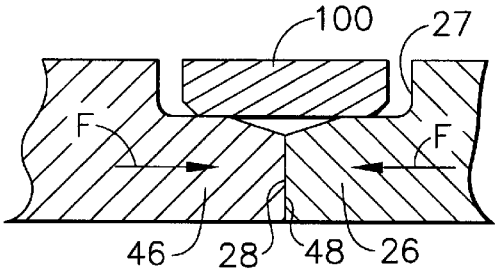
FIG. 3 is an enlarged view of the circled portion 3 of FIG. 2.
Figure 4:
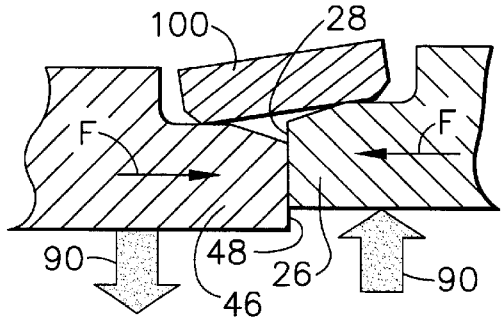
FIG. 4 is the same view as FIG. 3 showing the affect of thermal and/or centrifugal mismatch and the ability of the pilot ring to roll.

Referring to the drawings, FIG. 2 shows a portion of a gas turbine engine generally denoted by reference numeral 10 which is symmetric about an axial centerline 12. Going from right to left in the axial direction, the engine portion is comprised of the following components. A rotating component 16 having an axial facing surface 19 on a lip 18 that frictionally engages an axial facing surface 20 on a first lip 22 of compressor wheel 14. The compressor wheel 14 has a second lip 26 with an axial facing surface 28 that frictionally engages an axial facing surface 48 on a first lip 46 of a shaft member 24 that positions rotating shaft 13. A seal 23 is mounted to the shaft member 24 for sealingly engaging a housing portion 30. A first stage stator 32, having an array of vanes, is coupled on its inner diameter to the housing portion 30 and on its outer diameter to a turbine shroud, not shown. Moving downstream, (i.e. right to left), the shaft member 24 has a second lip 25. Adjacent the shaft member 24 is the first rotor stage 40. The first rotor stage 40 is comprised of a wheel 42 having a plurality of blades 44 extending from the perimeter of the wheel. The wheel 42 has a lip 47 that frictionally engages lip 25 with a prior art interference fit as illustrated in FIG. 1A (facing surfaces 6 and 7 from FIG. 1A are not included in FIG. 2). On its opposite axial side, the wheel 42 is coupled to the wheel 62 of the second stage rotor 60 by a conventional curvic coupling 61. The second stage rotor 60 in turn is coupled to a third stage rotor 80 by another curvic coupling 81. The second and third stage rotor are each comprised of a wheel, 62, 82 and a plurality of blades 64, 84. Disposed between the first stage rotor 40 and the second stage rotor 60 is a second stage stator 50 and between the second stage rotor 60 and the third stage rotor 80 is a third stage stator 70. Rotating components 14, 16, 24, 40, 60, and 80 are annular and their inner surfaces define a bore 15 that extends axially through the center of the turbine section 10. Also located between first stage rotor 40 and second stage rotor 60 is a rotating seal 91. Rotating seal 91 may function to prevent air movement from the outer cavity between first stage rotor 40 and second stage rotor 60 to the inner cavity defined by the bore 15. A tie shaft 13 is disposed within the bore 15 and applied an axial force that holds these rotating components together resulting in the frictional contact among the various surfaces mentioned above. Torque is transmitted through the frictional contact causing the components 14, 16, 24, 40, 60, and 80 to rotate. This axial force, represented by the letter "F" in FIGS. 3 and 4, is on the order of 30,000 lbf and this method of holding the components together is referred to as a lock-up. The actual axial load applied is dependent upon the torque being carried across the component faces. These rotating components are made from conventional gas turbine engine materials.

Still referring to FIG. 2, the lips 18 and 22 are configured to define an inner annular recess 21 extending along the inner diameter of the lips and beneath the radial plane of frictional contact between axial surfaces 19 and 20. Press fit into the recess 21 is a pilot ring 100. Similarly, as shown more clearly in FIG. 3, the lips 26 and 46 are configured to define an outer annular recess 27 extending along the outer diameter of the lips and over the radial plane of frictional contact between axial surfaces 28 and 48. Press fit into the recess 27 is a second pilot ring 100. With this arrangement the pilot ring 100 is not exposed to the axial load.

Referring to FIG. 4, the arrows 90 show the direction that the wheel 14 and shaft member 24 may move during operation of the engine as these components heat up, cool down, or grow radially due to speed at different rates. Because the pilot ring 100 is compliant to such differential growth, it can maintain the relative radial position of these two components to each other within acceptable tolerances. Importantly, because the pilot ring does not have to transmit the axial load it can more easily pivot radially and maintain contact with both components with out a large press fit. That is displacement of one end of the ring, while in the free-state, results in a rolling action and subsequent decrease in diameter at the other end. This rolling effect provides improved means to pilot adjacent components without the large interference fits found in prior art friction drive systems where the radial piloting feature is exposed to the axial clamping load and consequently has a very limited ability to roll.

Figure 5:
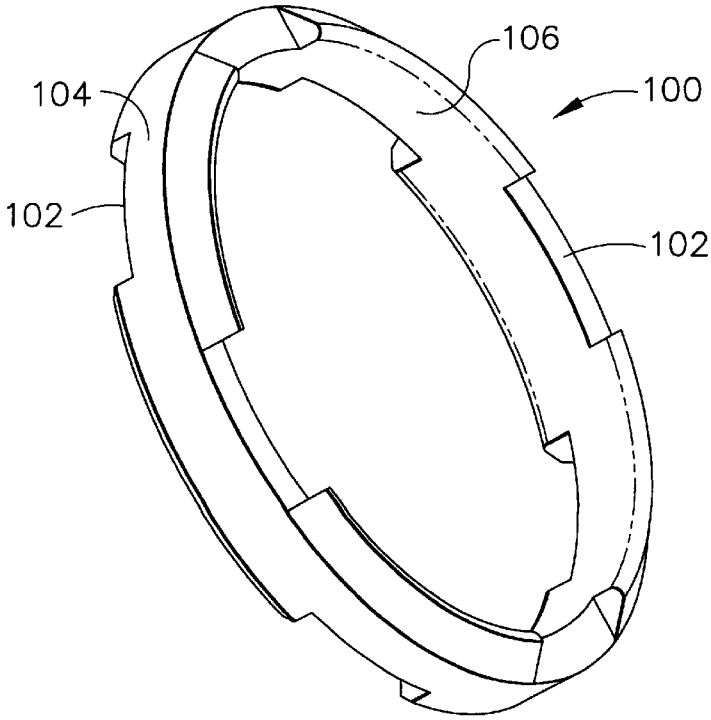
FIG. 5 a perspective view of the pilot ring used in coupling the rotating components as shown in FIG. 2.

Referring to FIG. 5, the pilot ring 100 may have a plurality of circumferentially spaced slots 102 on both of its axial edges. On the portion of these edges without a slot the edges are rounded. The slots and rounded edges make the pilot ring more compliant and allow for rolling in the radial direction as the various parts around the ring grow at different thermal rates. This helps to reduce the contact stresses. The pilot ring 100 may have a radially outward facing surface 104 or a radially inward facing surface 106 which provide radial positioning or piloting when the rings are mounted in the engine and improve ring rolling.

Figure 6:
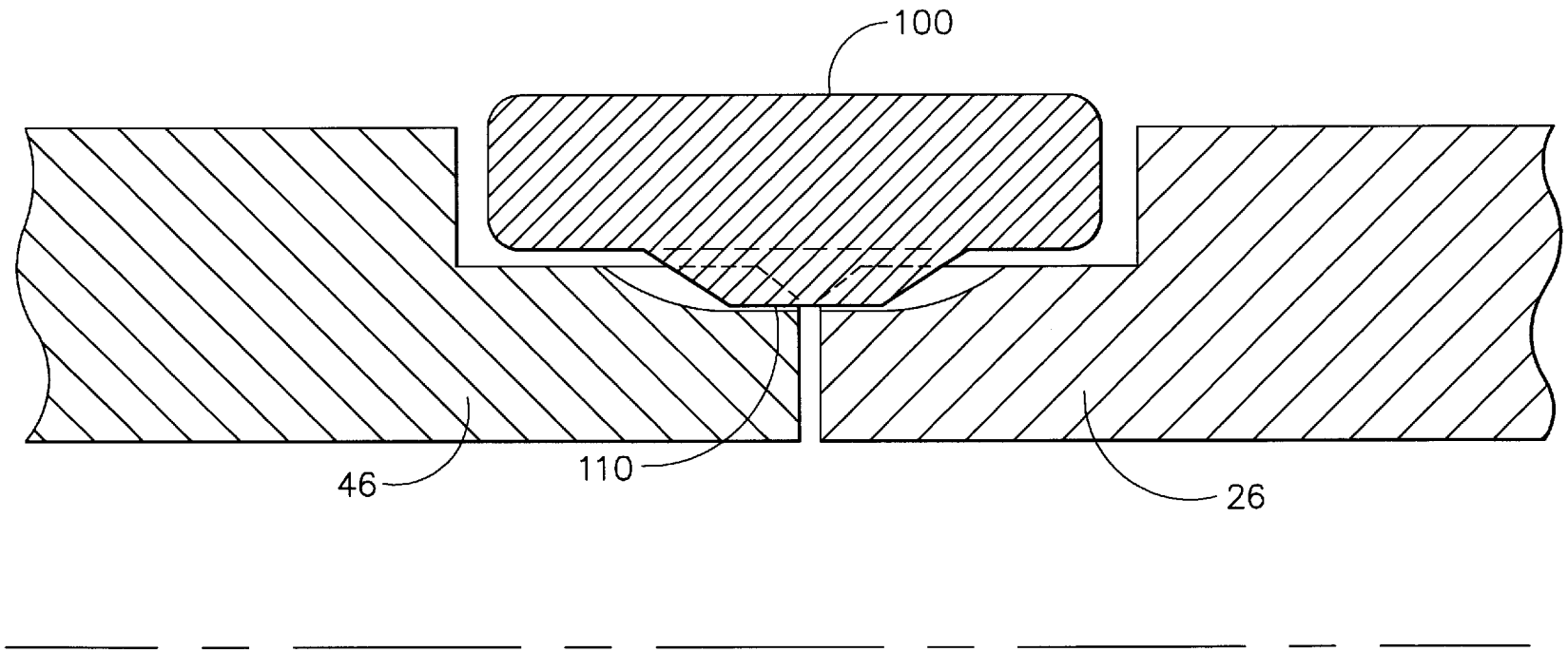
FIG. 6 is an illustration of an alternative embodiment of the pilot ring contemplated by the present invention.

In one alternative embodiment shown in FIG. 6, splines, pins or keys 110 can be incorporated into the ring 100 and adjacent parts of the assembly to prevent slippage in the event that the toque load exceeds the ability of the contacting axial surfaces to transfer the torque.

Thus a novel pilot ring is provided that makes the adjacent components easier to manufacture and balance. When the pilot rings are positioned on the outside, no balance tool is required which eliminates tooling errors and lowers the rotating group unbalance. The components can also be machined off of its centers reducing the time and cost to manufacture the component. Pilot rings and the contacting surfaces are easier to manufacture, inspect and repair than curvic couplings and provides better face parallelism. As a result, component tolerances and controls can be relaxed in comparison to components coupled by a curvic coupling.

Figure 7:
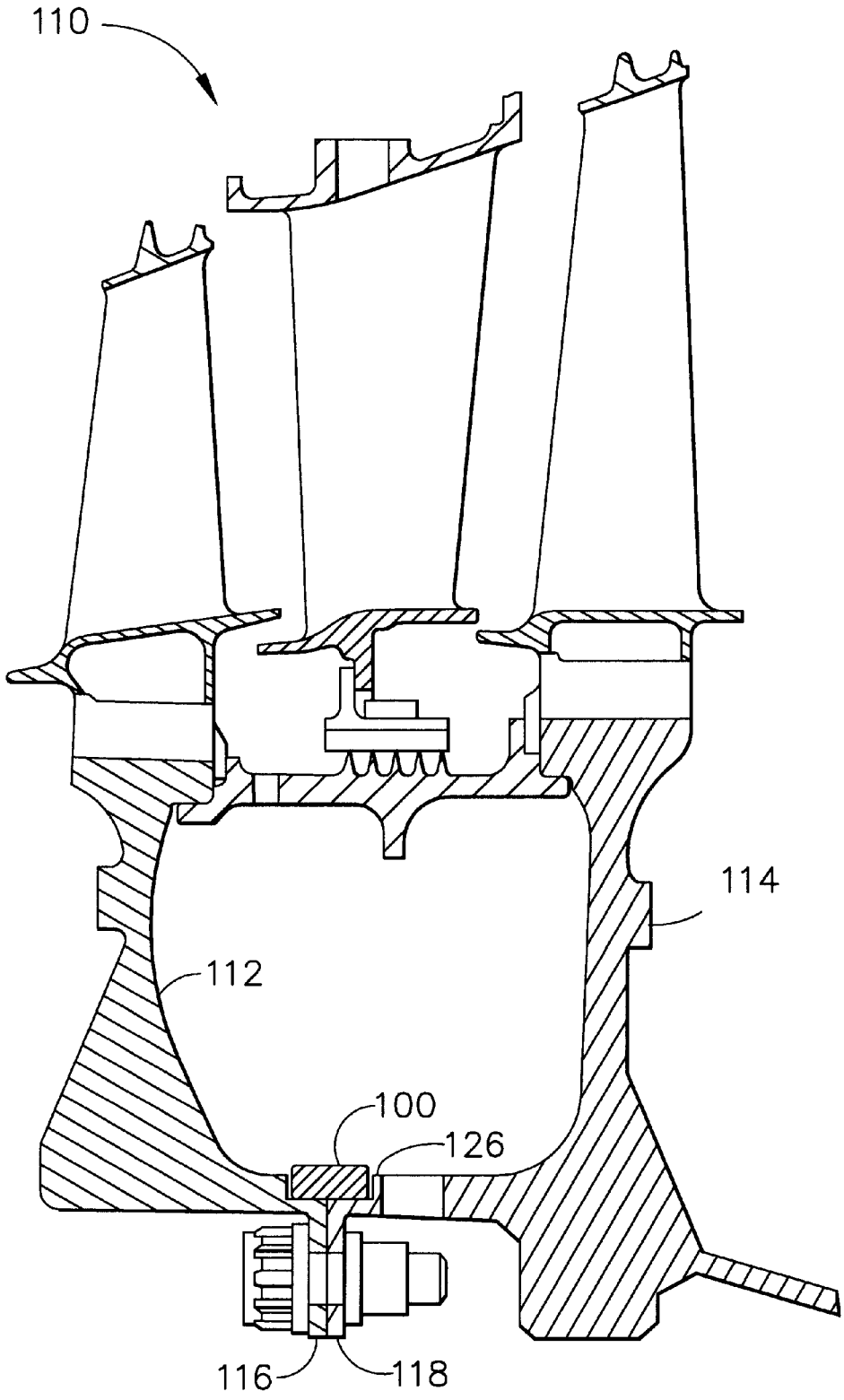
FIG. 7 is a cross-section of a gas turbine engine section in which the pilot ring contemplated by the present invention is disposed between rotating components that are bolted together.
Figure 8:
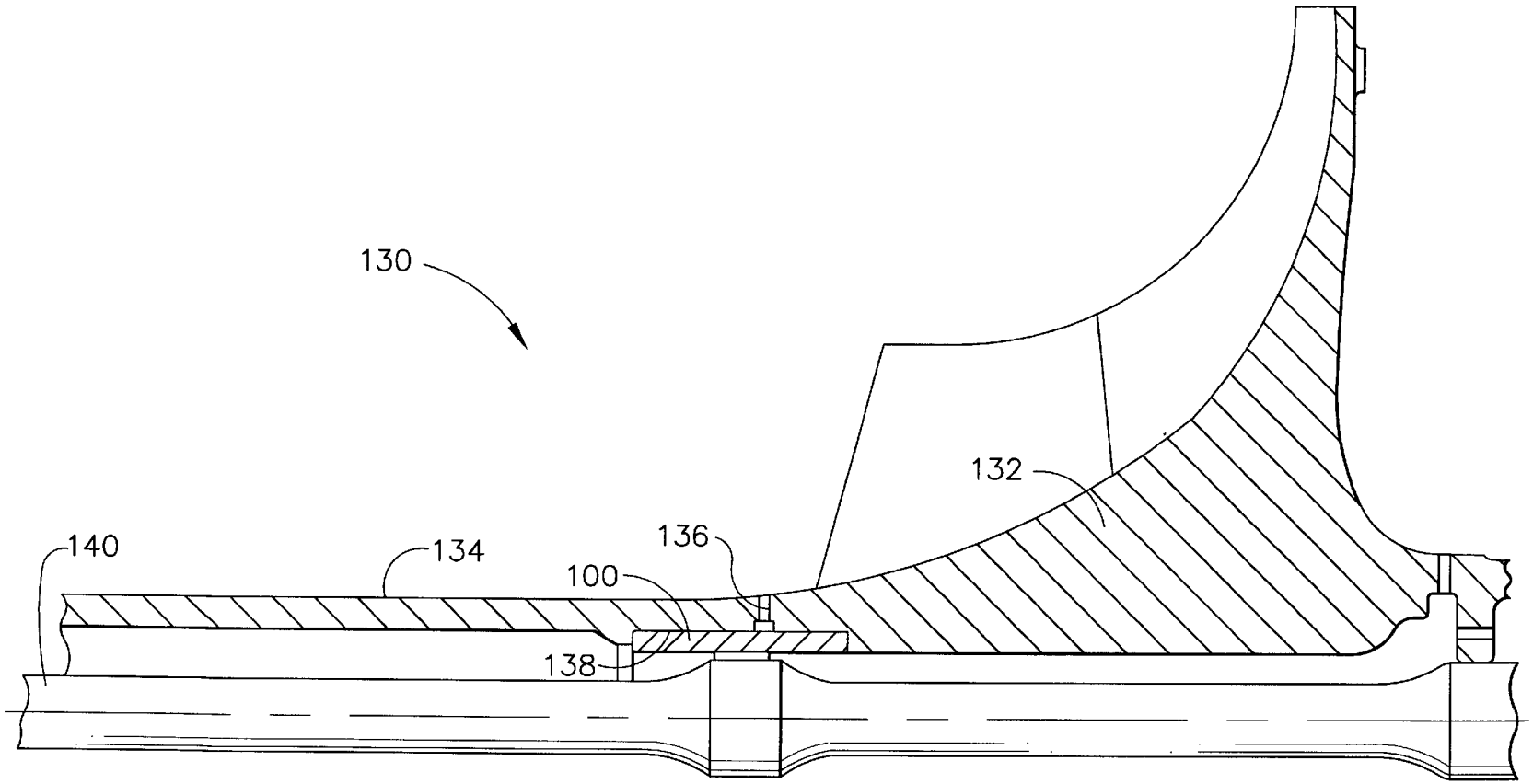
FIG. 8 is a cross-section of a gas turbine engine section in which the pilot ring is extended in length to provide shaft retention during the loss of axial clamp load.

The pilot ring 100 can also be employed in a wide variety of locations in a gas turbine engine. FIG. 7 shows a turbine assembly 110 with first and second turbine wheels 112, 114. Each of the wheels 112, 114 has a flange portion 116, 118 that are bolted together. In this embodiment, the pilot ring 100 is mounted in a groove 120 that circumscribes the bolted flanges. FIG. 8, shows a compressor assembly 130 in which a compressor wheel 132 is coupled to a shaft portion 134 and the pilot ring 100 is mounted in a groove 138 and lengthened to contribute to the containment of the shaft 140 in the event of a loss of tie shaft load.

Various other modifications and alterations to the above-described preferred embodiments will be apparent to those skilled in the art.

Accordingly, these descriptions of the invention should be considered exemplary and not as limiting the scope and spirit of the invention as set forth in the following claims.

What is claimed is:

1. A rotor assembly comprising:

a first rotatable component having a first lip with a first axial facing surface;

a second rotatable component having a second lip with a second axial facing surface, said first and second axial surfaces axially clamped and in frictional contact across a radial plane whereby torque is transmitted between the components; and a pilot ring mounted above or below said radial plane and the pilot ring being movable by movement of either of the first or second lips and the pilot ring maintaining the radial position of said first component with respect to said second component, said pilot ring being so disposed between said first and second component so as not to be axially clamped.

2. The assembly of claim 1 further comprising a recess disposed above or below said radial plane, said pilot ring being mounted in said recess so that said pilot ring can radially pivot and maintain contact with both components as the components grow radially at different rates.

3. The assembly of claim 2 wherein said pilot ring has a plurality of circumferentially disposed slots.

4. The assembly of claim 3 wherein said pilot ring has rounded axial edges.

5. The assembly of claim 4 wherein said pilot ring has means for preventing slippage.

6. The assembly of claim 1 wherein said first and second axial surfaces are bolted together.

7. The assembly of claim 1 wherein said pilot ring is lengthened to contribute to containment of a shaft in the event of loss of the load between said axially clamped first and second axial surfaces.

8. A rotor assembly comprising:

a first rotatable component having a first lip, the first lip extending from the rotatable component and terminating in a first axial facing surface;

a second rotatable component having a second lip, the second lip extending from the rotatable component and terminating in a second axial facing surface, said first and second axial facing surfaces being axially clamped and in frictional contact across a radial plane whereby torque is transmitted between the components; and a pilot ring mounted above or below said radial plane and the pilot ring being pivotable by movement of either of the first or second lips and the pilot ring maintaining the radial position of said first component with respect to said second component, said pilot ring being so disposed between said first and second component so as not to be axially clamped.

9. The assembly of claim 8 further comprising a recess disposed above or below said radial plane, said pilot ring being mounted in said recess so that said pilot ring can radially pivot and maintain contact with both components as the components grow radially at different rates.

10. The assembly of claim 9 wherein said pilot ring has a plurality of circumferentially disposed slots.

11. The assembly of claim 10 wherein said pilot ring has rounded axial edges.

12. The assembly of claim 11 wherein said pilot ring has means for preventing slippage.

13. The assembly of claim 8 wherein said first and second axial surfaces are bolted together.

14. The assembly of claim 8 wherein said pilot ring is lengthened to contribute to containment of a shaft in the event of loss of the load between said axially clamped first and second axial facing surfaces.

15. A rotor assembly comprising:

a first rotatable component rotatable about a rotation axis and having a first lip, the first lip extending from the rotatable component and terminating in a first axial facing surface, the first axial facing surface extending in a first direction which is generally perpendicular to the rotation axis;

a second rotatable component having a second lip, the second lip extending from the rotatable component and terminating in a second axial facing surfaces being axially clamped and in frictional contact across a radial plane whereby torque is transmitted between the components;

a pilot ring mounted above or below said radial plane to maintain the radial position of said first component with respect to said second component, said pilot ring being so disposed between said first and second component so as not to be clamped in a direction which is generally parallel to the rotation axis, said pilot ring having a plurality of circumferentially disposed slots and rounded axial edges; and a recess disposed above or below said radial plane, said pilot ring being mounted in said recess so that said pilot ring can radially pivot and maintain contact with both components as the components grow radially at different rates.

16. The assembly of claim 15 wherein said pilot ring has means for preventing slippage.

17. The assembly of claim 15 wherein said first and second axial surfaces are bolted together.

18. The assembly of claim 15 wherein said pilot ring is lengthened to contribute to containment of a shaft in the event of loss of the load between said axially clamped first and second axial surfaces.

* * * * *